US012546305B2

(12) United States Patent
Szczepaniak et al.

(10) Patent No.: US 12,546,305 B2
(45) Date of Patent: Feb. 10, 2026

(54) HYDRAULIC CIRCUIT ARRANGEMENT AND CONTROL SYSTEM FOR GANGED ELECTRONICALLY-COMMUTATED PUMPS

(71) Applicant: Danfoss Power Solutions Inc., Ames, IA (US)

(72) Inventors: Connor Szczepaniak, Nordborg (DK); Jeremie Lagarde, Nordborg (DK)

(73) Assignee: DANFOSS POWER SOLUTIONS, INC., Ames, IA (US)

( * ) Notice: Subject to any disclaimer, the term of this patent is extended or adjusted under 35 U.S.C. 154(b) by 211 days.

(21) Appl. No.: 18/555,748

(22) PCT Filed: Apr. 20, 2022

(86) PCT No.: PCT/US2022/025486

§ 371 (c)(1),
(2) Date: Oct. 17, 2023

(87) PCT Pub. No.: WO2022/226026

PCT Pub. Date: Oct. 27, 2022

(65) Prior Publication Data

US 2024/0200551 A1 Jun. 20, 2024

Related U.S. Application Data

(60) Provisional application No. 63/177,474, filed on Apr. 21, 2021.

(51) Int. Cl.
*F04B 49/06* (2006.01)
*F04B 1/053* (2020.01)
(Continued)

(52) U.S. Cl.
CPC ..... *F04B 49/065* (2013.01); *F04B 1/053* (2013.01); *F04B 1/06* (2013.01); *F04B 1/063* (2013.01);
(Continued)

(58) Field of Classification Search
CPC ..... F04B 49/065; F04B 1/053; F04B 1/06; F04B 1/063; F04B 7/0076; F04B 11/005;
(Continued)

(56) References Cited

U.S. PATENT DOCUMENTS 8,197,223 B2 * 6/2012 Kuttler ..... F04B 49/06 417/505
8,197,224 B2 * 6/2012 Kuttler ..... F04B 49/22 417/505
(Continued)

FOREIGN PATENT DOCUMENTS

EP 3 351 827 A1 7/2018
EP 3 748 155 A1 12/2020

OTHER PUBLICATIONS

International Search Report mailed on Jun. 22, 2022, in connection with corresponding International Application No. PCT/US2022/025486.

*Primary Examiner* — Peter J Bertheaud
(74) *Attorney, Agent, or Firm* — McCormick, Paulding & Huber PLLC

(57) ABSTRACT

A hydraulic circuit arrangement includes a plurality of electronically-commutated pumps providing flow to a common hydraulic line, the plurality of electronically-commutated pumps including one or more quantized electronically-commutated pumps and one or more unquantized electronically-commutated pumps. A controller includes a pressure controller and a flow divider. The pressure controller is configured to receive a pressure signal corresponding to the pressure within the common hydraulic line, to compare the pressure signal to a demanded pressure, and to determine a target flow value required to produce the demanded pressure. The flow divider is configured to receive the target flow value and allocate the target flow value into a quantized target flow value for allocation among
(Continued)

the one or more quantized electronically-commutated pumps and an unquantized target flow value for allocation among the one or more unquantized electronically-commutated pumps.

15 Claims, 6 Drawing Sheets

(51) Int. Cl.

| | |
|---|---|
| ***F04B 1/06*** | (2020.01) |
| ***F04B 1/063*** | (2020.01) |
| ***F04B 7/00*** | (2006.01) |
| ***F04B 11/00*** | (2006.01) |
| ***F04B 23/06*** | (2006.01) |
| ***F04B 49/03*** | (2006.01) |
| ***F04B 49/22*** | (2006.01) |

(52) U.S. Cl.
CPC ..... *F04B 7/0076* (2013.01); *F04B 11/005* (2013.01); *F04B 23/06* (2013.01); *F04B 49/03* (2013.01); *F04B 49/06* (2013.01); *F04B 49/22* (2013.01); *F04B 2205/05* (2013.01); *F04B 2205/09* (2013.01)

(58) Field of Classification Search
CPC ..... F04B 23/06; F04B 49/03; F04B 49/06; F04B 49/22; F04B 2205/05; F04B 2205/09
See application file for complete search history.

(56) References Cited

U.S. PATENT DOCUMENTS

| | | | | |
|---|---|---|---|---|
| 8,206,125 | B2 * | 6/2012 | Kuttler | F04B 11/005 417/505 |
| 9,976,641 | B2 * | 5/2018 | Caldwell | F04B 11/00 |
| 10,995,476 | B2 * | 5/2021 | Caldwell | F04B 1/053 |
| 11,441,549 | B2 * | 9/2022 | Dole | F04B 49/22 |
| 2013/0205763 | A1 * | 8/2013 | Caldwell | F04B 49/065 60/459 |
| 2017/0306936 | A1 | 10/2017 | Dole et al. | |
| 2020/0208521 | A1 * | 7/2020 | Caldwell | F04B 53/001 |

* cited by examiner

| Time steps | $Q_t$ (L/min) | Fd ECP1 (-) | Fd ECP2 (-) | Fd ECP3 (-) | Fd ECP4 (-) |
|---|---|---|---|---|---|
| 1 | 50 | 0.5 | 0 | 0 | 0 |
| 2 | 60 | 0.6 | 0 | 0 | 0 |
| 3 | 70 | 0.7 | 0 | 0 | 0 |
| 4 | 80 | 0.55 | 0.25 | 0 | 0 |
| 5 | 90 | 0.65 | 0.25 | 0 | 0 |
| 6 | 100 | 0.75 | 0.25 | 0 | 0 |
| 7 | 110 | 0.6 | 0.25 | 0.25 | 0 |
| 8 | 120 | 0.7 | 0.25 | 0.25 | 0 |
| 9 | 130 | 0.55 | 0.25 | 0.25 | 0.25 |
| 10 | 140 | 0.65 | 0.25 | 0.25 | 0.25 |
| 11 | 150 | 0.75 | 0.25 | 0.25 | 0.25 |
| 12 | 160 | 0.6 | 0.5 | 0.25 | 0.25 |

FIG. 6

HYDRAULIC CIRCUIT ARRANGEMENT AND CONTROL SYSTEM FOR GANGED ELECTRONICALLY-COMMUTATED PUMPS

CROSS-REFERENCE TO RELATED APPLICATIONS

This application is a National Stage application of International Patent Application No. PCT/US2022/025486, filed on Apr. 20, 2022, which claims priority to U.S. Provisional Patent Application No. 63/177,474, filed on Apr. 21, 2021, each of which is hereby incorporated by reference in its entirety.

TECHNICAL FIELD

The disclosure relates to a hydraulic circuit arrangement and a system and method for control of a plurality of electronically-commutated pumps, and more specifically, to a plurality of ganged electronically-commutated pumps.

BACKGROUND

For purposes of this application, an electronically-commutated pump (EC pump or ECP) is a hydraulic displacement pump capable of opening and/or closing of individual low- and high-pressure valves of each piston cylinder assembly on a cycle-by-cycle basis to provide a determined net displacement of fluid through each EC pump. The determined net displacement may be constant or variable (within a given cycle, per cycle, or across multiple cycles). In a preferred embodiment, each EC pump is provided with an associated electronically-commutated pump controller (EC pump controller or ECP controller) which controls whether to enable or disable any given individual piston cylinder assembly of the EC pump based on a displacement command for the EC pump. The ECP controllers thus regulate the opening and/or closing of individual low- and high-pressure valves of the EC pumps, to determine the displacement of fluid through each piston cylinder assembly on a cycle-by-cycle basis to determine the net displacement of fluid through each EC pump. Such EC pumps are known. For example, Danfoss markets a line of EC pumps under the Digital Displacement® trademark.

EC pumps may include a plurality of piston cylinder assemblies circumferentially arranged around and extending radially outward from a central crankshaft. Each piston cylinder assembly has an inlet valve and an outlet valve. Each inlet valve (and optionally each outlet valve) may be independently and selectively opened and/or closed so as to independently and selectively disable or enable each piston cylinder assembly. When piston cylinder assemblies of an EC pump are sequentially disabled and/or enabled according to certain patterns, the EC pump may experience undesirable frequencies and/or undesirable ripple or pulsation effects.

Examples of EC pumps and methods for controlling the individual piston cylinder assemblies or of groups of piston cylinder assemblies of an EC pump are addressed in, for example, U.S. Pat. No. 9,976,641 to Caldwell et al. (Ser. No. 15/022,397, filed on Feb. 25, 2014), and U.S. Published Patent Application No. 2017/0306936 to Dole et al. (Ser. No. 15/518,377, filed on Apr. 11, 2017), each of which is herein incorporated by reference in its entirety. Such a control system may account for the primary consideration of fulfilling the fluid flow/mechanical power demands, while also taking into consideration the overall behavior of the system.

In applications where significant and/or highly pressurized fluid is required, such as when pressurized fluid is used to power one or more hydraulic loads, multiple EC pumps may be desirable. In some instances, these EC pumps may be ganged, into groups, in order to provide pressurized fluid via one or more common hydraulic lines to the one or more hydraulic loads.

SUMMARY

According to certain embodiments, in order to control pressure in a system where two or more EC pumps are joined at their outlet, the pressure control logic is moved into a system-level controller. In some instances, the control strategy uses displacement quantization to minimize undesirable pressure ripple and phasing effects.

In applications where a high-pressure working fluid is used to power multiple hydraulic loads, multiple EC pumps are typically required. Because of the digital flow control, the flow output of an EC pump may have more pulsation than conventional pumps. In terms of fluid-borne noise, and pressure and flow ripple, an EC pump generally emits lower frequency pulsations than conventional piston pumps. When two or more EC pumps are ganged and pumping together in a hydraulic circuit arrangement, the output pressure ripple may phase in and out, causing low beat frequencies and/or simultaneous pulses from separate machines.

The system-level controller includes pressure control logic and flow allocation logic. The pressure control logic calculates a flow target value needed to reach the pressure reference value (therefore the gains are in terms of flow). The flow allocation logic takes the calculated flow target value and allocates it among two or more EC pumps. One or more of the EC pumps are quantized to a subset of their possible fractional displacement values to minimize or reduce their pulsation. The other EC pumps may be unquantized to account for error between flow target value and the total quantized flow, and/or to perform fine control.

The below-disclosed hydraulic circuit arrangement and control strategy coordinate the flow commands allocating the flow demand among the EC pumps to ameliorate the problematic dynamics in the system. The control strategy may use displacement quantization for some pumps in conjunction with unquantized displacement in other pumps to minimize pressure ripple and phasing effects. In practice, if the displacement fraction is limited to only quantized steps, then the output flow may be either too high or too low and the pressure slowly may diverge from its setpoint. The integrator term (from the pressure control loop) "hunts" this error and as a result the displacement command may oscillate between the quantized fractional displacements at a low frequency. Thus, for the pressure control loop to work effectively, it may be desirable to include at least one unquantized pump among the plurality of quantized EC pumps. The finer displacement steps of the unquantized pump allows the pressure control loop to home in on the pressure setpoint more efficiently, reducing or eliminating pressure undershoot or overshoot.

According to an aspect of the invention, a system-level controller is provided for a hydraulic circuit arrangement which includes a plurality of EC pumps providing flow to a common hydraulic line. The plurality of EC pumps includes one or more quantized EC pumps and one or more unquantized EC pumps. A quantized EC pump is an EC pump operated according to a quantized regime, and a unquantized EC pump is an EC pump operated according to a 'normal' unquantized regime. The system-level controller includes pressure control logic and flow allocation logic. The pressure control logic may be contained in a pressure controller, for example, a proportional integral derivative controller. The flow allocation logic may be contained in a flow divider.

According to a preferred embodiment, the pressure controller may be configured to receive a pressure signal corresponding to the pressure within the common hydraulic line. The pressure signal may be measured directly using, for example, a pressure transducer, or the pressure signal may be indirectly determined or deduced. The logic within the pressure controller may determine a pressure difference by comparing the pressure signal to a demanded pressure or a requested pressure. This pressure difference may be used to determine a target flow value required to eliminate the pressure difference, and thereby produce the demanded pressure.

According to a preferred embodiment, a flow divider may be configured to receive the target flow value (determined by the pressure control logic) and allocate the target flow value into a quantized target flow value and an unquantized target flow value. The quantized target flow value may be allocated or distributed among the one or more quantized EC pumps. The unquantized target flow value may be allocated among the one or more unquantized EC pumps. Each pump comprises three or more piston cylinder assemblies operated in a respectively quantized or unquantized EC regime. Further, the flow divider may allocate the quantized target flow value to a plurality of quantized EC pumps. It is the flows from the individual piston cylinder assemblies of the respective pumps which combine to contribute flow to meet the target flow value. The work that will be demanded of/from various pumps to meet a corresponding target flow value may be distributed in a form of 'load/work levelling'. This seeks to distribute the wear experienced during operation across a number of pumps, or across a number of piston cylinder assemblies.

According to other embodiments, the flow divider may change the unquantized target flow value at a higher frequency than the frequency with which the quantized target flow value is changed. Thus, the controller may update the displacement command allocating the unquantized target flow value to the unquantized EC pump(s) more often than the displacement command allocating the quantized target flow value to the quantized EC pump(s).

The flow divider may allocate the quantized target flow value to and select from a plurality of the one or more quantized EC pumps (specifically the piston cylinder assemblies of those pumps) such that the contributing pulses of fluid from those pumps are spaced as evenly as possible in terms of phase. The relative position of one piston compared to another in the respective piston cylinder cycles is important. The relative positions of the two (or more pistons) can be defined in terms of angle (circumferentially around the main pump shaft) as the relative phase of the two pistons. 'Equally phased' would be such that the positions of the pistons would be spread evenly around the main pump shaft. Optionally, the flow divider may decide to allocate the majority of the quantized target flow value to a first one of the quantized EC pumps, while a second one of quantized EC pumps has no or little flow allocated thereto.

Quantized EC pumps may have differing levels of quantization. For example, at least one of the one or more quantized EC pumps may be a commonly-quantized EC pump. A commonly-quantized EC pump may have on the order of 12 to 24 fractional displacement steps. As another example, at least one of the one or more quantized EC pumps may be a robustly-quantized EC pump. A robustly-quantized EC pump may have on the order of 6 to 11 fractional displacement steps. As another example, at least one of the one or more quantized EC pumps may be a heavily-quantized EC pump. A heavily-quantized EC pump may have 5 or fewer fractional displacement steps. For any given hydraulic arrangement having a plurality of quantized EC pumps, the individual quantized EC pumps may have the same or similar levels of quantization or the individual quantized EC pumps may have different levels of quantization.

As noted, a quantized EC pump may have a fractional displacement series that is equally-spaced over the series. According to another option, a quantized EC pump may have a fractional displacement series only over a span or range of its possible displacement steps. In other words, for example, a quantized EC pump may be "quantized" at a low flow rate, but unquantized at a high flow rate (or vice versa). Alternatively, a quantized EC pump may have a fractional displacement series that follows a logical progression, for example, a Farey sequence. Even further, a quantized EC pump may have a seemingly random set of fractional displacement steps, wherein the fractional displacement steps are defined to avoid selected undesirable frequencies. As a non-limiting example, a quantized EC pump may be more quantized at a low flow rate (i.e., have fewer available fractional displacement steps for a given range of displacement) and less quantized at a higher flow rate (i.e., have a greater number of available fractional displacement steps for the same given range of displacement).

According to certain embodiments, the unquantized EC pumps have a continuously variable displacement. For example, at least one of the unquantized EC pumps may be a strictly-unquantized EC pump. A strictly-unquantized EC pump would be capable of producing a displacement for every level of the pump's native ECP controller. Thus, if an EC pump is manufactured to provide a high number of displacement steps, a strictly-unquantized version would have the same high number of fractional displacement steps. The high number of fractional displacements would be determined by the resolution level of the ECP controller, and may be so high that it is well beyond anything perceivable by the user. According to another example, at least one of the unquantized EC pumps may be an effectively-unquantized EC pump. Such an effectively-unquantized EC pump would not be capable of producing a displacement for every level of the pump's native ECP controller, but would be able to produce a displacement for at least 200 or more fractional displacement steps, the point at which the user starts to perceive quantization. According to another example, at least one of the unquantized EC pumps may be a nominally-unquantized EC pump. Such a nominally-unquantized EC pump would not be capable of producing a displacement for every level of the pump's native ECP controller, but would be able to produce a displacement for at least 100 or more fractional displacement steps. According to a further example, at least one of the unquantized EC pumps may be a practically-unquantized EC pump. As with the nominally-unquantized pump described above, such a practically-unquantized EC pump would not be capable of producing a displacement for every level of the pump's native ECP controller, but would be able to produce a displacement for at least 50 or more fractional displacement steps. Each of these strictly-, effectively-, nominally-, and practically-unquantized pumps are capable of providing a fine distribution of fractional displacement steps.

According to certain preferred embodiments, the flow divider may compare the unquantized target flow value to a predetermined upper threshold displacement value to determine if a portion of the unquantized target flow value can be reallocated to the quantized target flow value. Further, the flow divider may compare the unquantized target flow value to a predetermined lower threshold displacement value to determine if a portion of the quantized target flow value can be reallocated to the unquantized target flow value.

According to another aspect of the invention, a hydraulic circuit arrangement having a plurality of EC pumps providing flow to a common hydraulic line may be provided. The plurality of EC pumps may include one or more quantized EC pumps and may include one or more unquantized EC pumps. The hydraulic circuit arrangement may further include a hydraulic circuit arrangement system-level controller having a pressure controller portion and a flow divider portion. The pressure controller may be configured to receive a pressure signal corresponding to the pressure within the common hydraulic line, to compare the pressure signal to a demanded pressure, and to determine a target flow value required to produce the demanded pressure. The flow divider may be configured to receive the target flow value and allocate the target flow value into a quantized target flow value for allocation among the one or more quantized EC pumps and an unquantized target flow value for allocation among the one or more unquantized EC pumps.

Further to another aspect of the invention, a hydraulic circuit arrangement may include a plurality of EC pumps providing flow to a common hydraulic line. In certain embodiments, the plurality of EC pumps may be grouped to provide pressurized fluid via one or more common hydraulic lines to service one or more hydraulic loads in various combinations. As above, the plurality of EC pumps may include one or more quantized EC pumps and may include one or more unquantized EC pumps. The one or more quantized EC pumps may produce a quantized flow that is less than a total target flow value determined for the common hydraulic line. The one or more unquantized EC pumps may produce an unquantized flow that is the difference between the flow produced by the one or more EC pumps and the total target flow value.

According to one embodiment, the quantized flow may be produced by a plurality of the quantized EC pumps, with the quantized flow being distributed between the plurality of the quantized EC pumps as evenly as possible.

According to another embodiment, the quantized flow may be maximized and the unquantized flow may be minimized.

It is understood, this hydraulic circuit arrangement could additionally include one or more of the features discussed above, with respect to the controllers and with respect to the quantized and unquantized EC pumps.

Finally, according to another aspect of the invention, a method for allocating a target flow value to a plurality of EC pumps providing flow to a common hydraulic line may be provided. As above, the plurality of EC pumps may include one or more quantized EC pump and may include one or more unquantized EC pump. The method may include determining a target flow value required to produce a demanded pressure in the common hydraulic line. The method may further include determining a quantized flow value currently produced by the one or more quantized EC pumps. The method may include calculating a difference between the target flow value and the quantized flow value, and checking if the difference between the target flow value and the quantized flow value is less than a lower threshold displacement value and/or greater than an upper threshold displacement value. If the difference is less than a lower threshold displacement value, the method may include reducing the quantized flow value allocated to the one or more quantized EC pumps. If the difference is more than an upper threshold displacement value, the method may include increasing the quantized flow value allocated to the one or more quantized EC pumps.

It is understood that, generally, the EC pumps need not be identical. Thus, as a nonlimiting example, one of the quantized EC pumps could have a full or 100% flow displacement of 100 cc/rev and may typically spin at 1000 rpm, while another of the quantized EC pumps could have a full or 100% flow displacement of 200 cc/rev and may typically spin at 1800 rpm.

Further, the values for the fractional displacements of the quantized EC pumps can be any value, evenly or unevenly distributed. Even further, it is understood that the values for the fractional displacements of the quantized EC pumps need not be the same for each of the different quantized EC pumps. Thus, as a non-limiting example, one of the quantized EC pumps could be quantized with fractional displacement values: Fd={0, 0.25, 0.5, 0.75, 1}; while another of the quantized EC pumps could be quantized with a Farey sequence of fractional displacement values, for example, using a Farey sequence of order n=3: Fd={0/1, 1/3, 1/2, 2/3, 1/1}.

According to some embodiments, the unquantized EC pumps may be updated at a high frequency (for example, in the order of 1 or 2 milliseconds), while the quantized EC pumps may be updated at a much slower frequency (for example, ten times or one hundred times less often).

In some embodiments, the flow allocation logic may also consider torque or power limits when allocating flow. It is expected that the flow allocation logic should not allocate more flow than the one or more prime movers have power for at the measured pressure. Thus, the individual limits on the prime movers' power may be considered when allocating flow among the pumps. Further, the flow allocation logic may be provided, as input, signals corresponding to the speeds of the shafts of each of the individual EC pumps.

According to another aspect, a hydraulic circuit arrangement is provided with a plurality of electronically-commutated pumps and one or more continuously-variable pumps providing flow to a common hydraulic line. Each of the electronically-commutated pumps is provided with an associated electronically-commutated pump controller configured to determine whether to enable or disable individual piston cylinder assemblies of the electronically-commutated pumps based on a displacement command for the respective electronically-commutated pump. Further, the electronically-commutated pump controllers are configured to regulate the opening and/or closing of individual low and/or high pressure valves of the electronically-commutated pumps to thereby determine the displacement of fluid through each piston cylinder assembly on a cycle-by-cycle basis. The plurality of electronically-commutated pumps includes one or more quantized electronically-commutated pumps, wherein the one or more quantized electronically-commutated pumps are configured to produce a quantized target flow value that is less than a total target flow value determined for the common hydraulic line. The one or more continuously-variable pumps are configured to produce an unquantized target flow value that is the difference between the quantized target flow value and the total target flow value.

BRIEF DESCRIPTION OF THE DRAWINGS

Example embodiments of the present invention will now be illustrated with reference to the following Figures.

FIG. 6 is a table of hydraulic fluid output from individual the EC pumps as flow demand is increased in steps in accordance with an aspect of the present invention.

The scope of the present invention is not limited to the above schematic drawings, the number of constituting components, the relative arrangement thereof, etc. These drawings are disclosed simply as examples of embodiments.

DETAILED DESCRIPTION

EC pumps (ECP) are based on hydraulic pump technology and an ECP controller that selectively enables each individual piston by actuating corresponding on/off inlet and, optionally, outlet valves. In this way, the pump's flow displacement is digitally variable, resulting in fast and accurate flow control.

Figure 1:
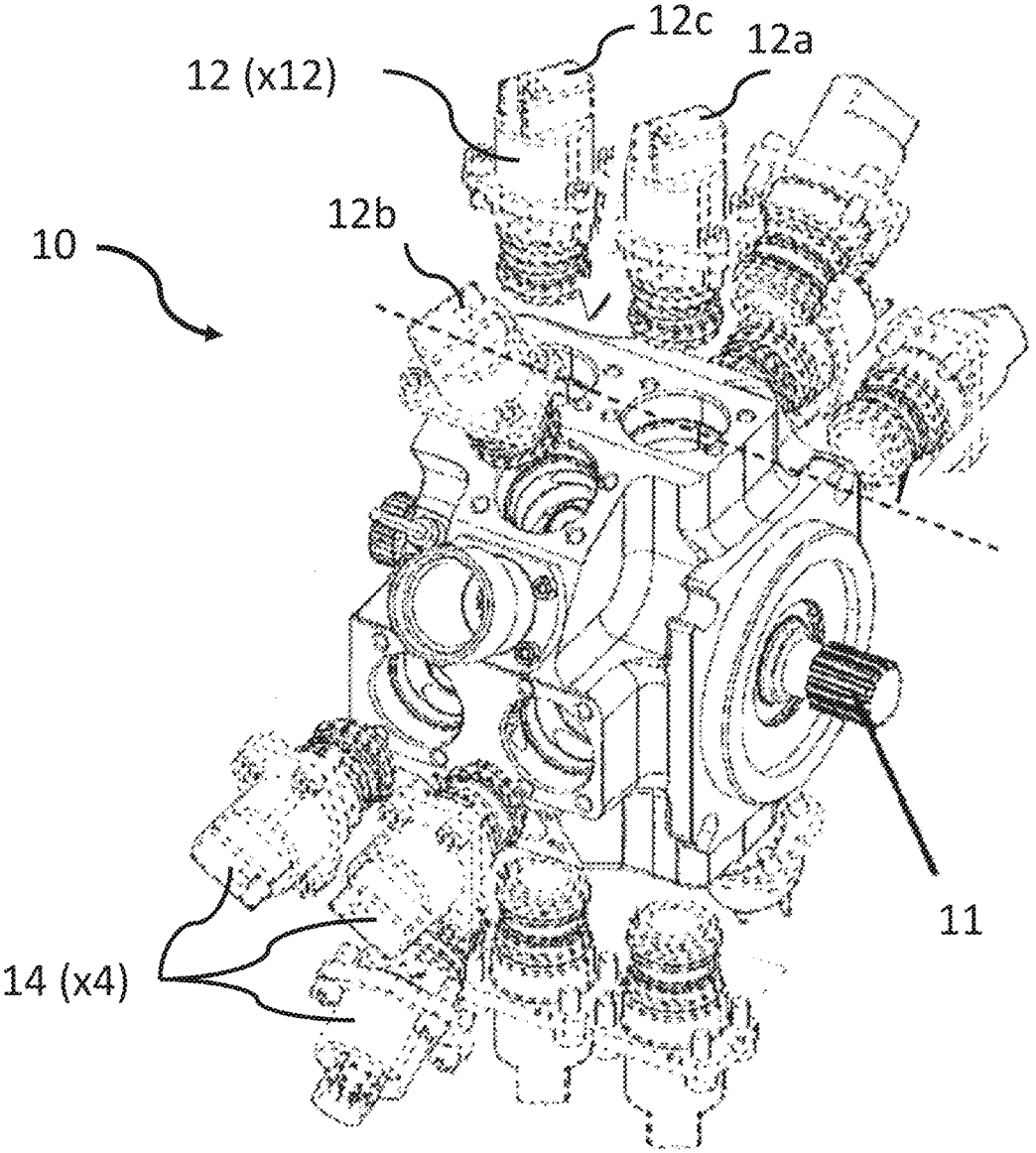
FIG. 1 is an exploded perspective of an embodiment of an EC pump in accordance with an aspect of the present invention.

As shown in the embodiment of FIG. 1, an EC pump 10 includes a crankshaft 11, rotatable about an axis of rotation, and a plurality of piston cylinder assemblies 12. In one typical configuration, the plurality of piston cylinder assemblies 12 may be circumferentially arranged around the crankshaft and extend radially outwards from the crankshaft. As shown in FIG. 1, the piston cylinder assemblies 12 may also be arranged as a plurality of axially offset disks or arrays of piston cylinder assemblies 12, each disk having a plurality of piston cylinder assemblies 12 circumferentially arranged about the axis of rotation and lying in a plane extending perpendicularly to the axis of rotation of the crankshaft 11. The crankshaft 11 may have a plurality of axially offset cams (not shown), with at least one cam associated with each disk for driving the pistons in that disk.

Inlet and outlet valves (inside the piston cylinder assemblies' housings—not shown) are associated with each of the pump's piston cylinder assemblies 12. The inlet valve is typically a low-pressure valve; the outlet valve is typically a high-pressure valve. These inlet and outlet valve arrangements are known for EC pumps 10. In certain embodiments, the outlet valve may be passive and the inlet valve may be actively controlled. In other embodiments, both the outlet valve and the inlet valve may be actively controlled. For example, these valves may be opened and/or closed by energizing a solenoid coil which is controlled by an ECP controller 18 (see FIG. 2).

As the crankshaft 11 rotates and the cams drive the pistons of the piston cylinder assemblies 12, the ECP controller 18 determines whether or not any given piston cylinder assembly 12 will be enabled to pump fluid through the outlet valve. If the piston cylinder assembly 12 is to be enabled or active, the inlet valve is initially in the open position, thereby allowing fluid to flow into the cylinder. Generally, the ECP controller 18 may close the inlet valve when the piston is at bottom dead center. The fluid displaced by the piston moving upward is then forced through the outlet valve. If the piston is to be disabled or inactive, the inlet valve remains in the open position. The fluid displaced by the piston moves freely back and forth through the inlet valve and no fluid is discharged through the outlet valve. Optionally, the ECP controller 18 may operate the inlet valve to provide partial piston strokes, e.g., the inlet valve may be held in the closed-position during part of the piston's upstroke and in the open-position during another part of the piston's upstroke, such that only a portion of the piston's swept volume is discharged through the outlet valve during any given stroke. Thus, it can be understood that the net displacements of working fluid by the different piston cylinder assemblies 12 and by the different groups 14 of piston cylinder assemblies 12 can be controlled independently of each other.

In the embodiment of FIG. 1, the EC pump 10 has twelve piston cylinder assemblies arranged around the common crankshaft. In this example, every piston cylinder assembly 12 may be enabled at full displacement (displacement fraction Fd=1), and every piston cylinder assembly 12 may be disabled at Fd=0. For a displacement fraction between zero and one hundred percent (i.e., 0<Fd<1), the ECP controller 18 may use a sequence of enabled and disabled piston cylinder assemblies 12 which are represented by ones and zeros respectively. As an example, for a displacement fraction of 0.5, a repeated 2-step piston sequence of 01 . . . may be used. For a displacement fraction of 0.25, a repeated 4-step piston sequence of 0001 . . . may be used. For a displacement fraction of 7/12, a repeated 12-step piston sequence of 010101101011 . . . may be used. For a displacement fraction of 19/24, a repeated 24-step piston sequence of 111101111011 110111101110 . . . may be used.

Thus, it can be seen that the desired displacement fraction may be achieved as an average over time. Some displacement fractions can be achieved with short sequences like 01 . . . or 001 . . . within a single revolution. Other displacement fractions are achieved with longer sequences and may be averaged over multiple revolutions of the crankshaft. For example, a displacement fraction Fd=0.792=19/24 has ten active piston cylinder assemblies 12 during the first revolution of the crankshaft and nine active piston cylinder assemblies 12 during the second revolution. A displacement fraction Fd=0.51 requires a repeating sequence having a length of one-hundred with fifty-one ones and forty-nine zeros. Any value of displacement fraction can be achieved with a sufficiently long binary sequence.

In general, the ECP controller 18 need not use fixed or pre-programmed sequences of enabled and disabled piston cylinder assemblies 12. For example, as the crankshaft 11 rotates, the ECP controller 18 may determine whether to enable or disable the next piston cylinder assembly 12 in the sequence based on the current displacement fraction command and the history of piston cylinder assemblies enabled/disabled. The same piston cylinder assemblies 12 are not necessarily enabled or disabled during each full rotation of the crankshaft 11, but can change with each shaft rotation.

As one example, the ECP controller 18 may incorporate a displacement determination algorithm for determining the displacement by individual cylinders in a normal operating mode. Such an example algorithm is disclosed in U.S. Pat. No. 9,976,641 to Caldwell et al. (Ser. No. 15/022,397, filed on Mar. 16, 2016), which is herein incorporated by reference in its entirety. In this algorithm (which may be referred to as a "Sigma-Delta Algorithm"), the difference between the amount of working fluid displacement demanded and the amount of working fluid which is actually displaced is determined. As the shaft is rotated, prior to any given piston cylinder assembly being actuated, the algorithm determines whether or not to enable that piston cylinder assembly. The difference calculated above is added to the demanded displacement and this sum is checked against a predetermined threshold value. The threshold value may be equal to the volume of the working fluid that is displaceable by the piston cylinder assembly. If the sum is greater than or equal to the threshold, the piston cylinder assembly is enabled. These steps are repeated for each piston cylinder assembly as the shaft rotates.

An EC pump 10 may operate in a flow control mode. To regulate flow, the ECP controller may compare a measured flow to the desired flow and calculate a displacement fraction and a corresponding displacement command sequence.

Alternatively, an EC pump 10 may operate in a pressure control mode. To regulate pump pressure, the ECP controller 18 may compare a measured pressure to the desired pressure and calculate a displacement command using, for example, a proportional-integral-derivative control algorithm. The EC pump 10 may be an open circuit pump and may use closed loop control of output pressure to achieve a target pressure set by an operator. A pressure transducer may be supplied on or with the EC pump 10, and the ECP controller 18 may be configured to receive signals from this sensor. A shaft speed sensor may also be integrated into the EC pump 10 for the ECP controller 18 to determine which piston cylinder assemblies 12 must be enabled or disabled and which valves must be open or closed to create the flow rate needed to produce the target pressure.

Figure 2:
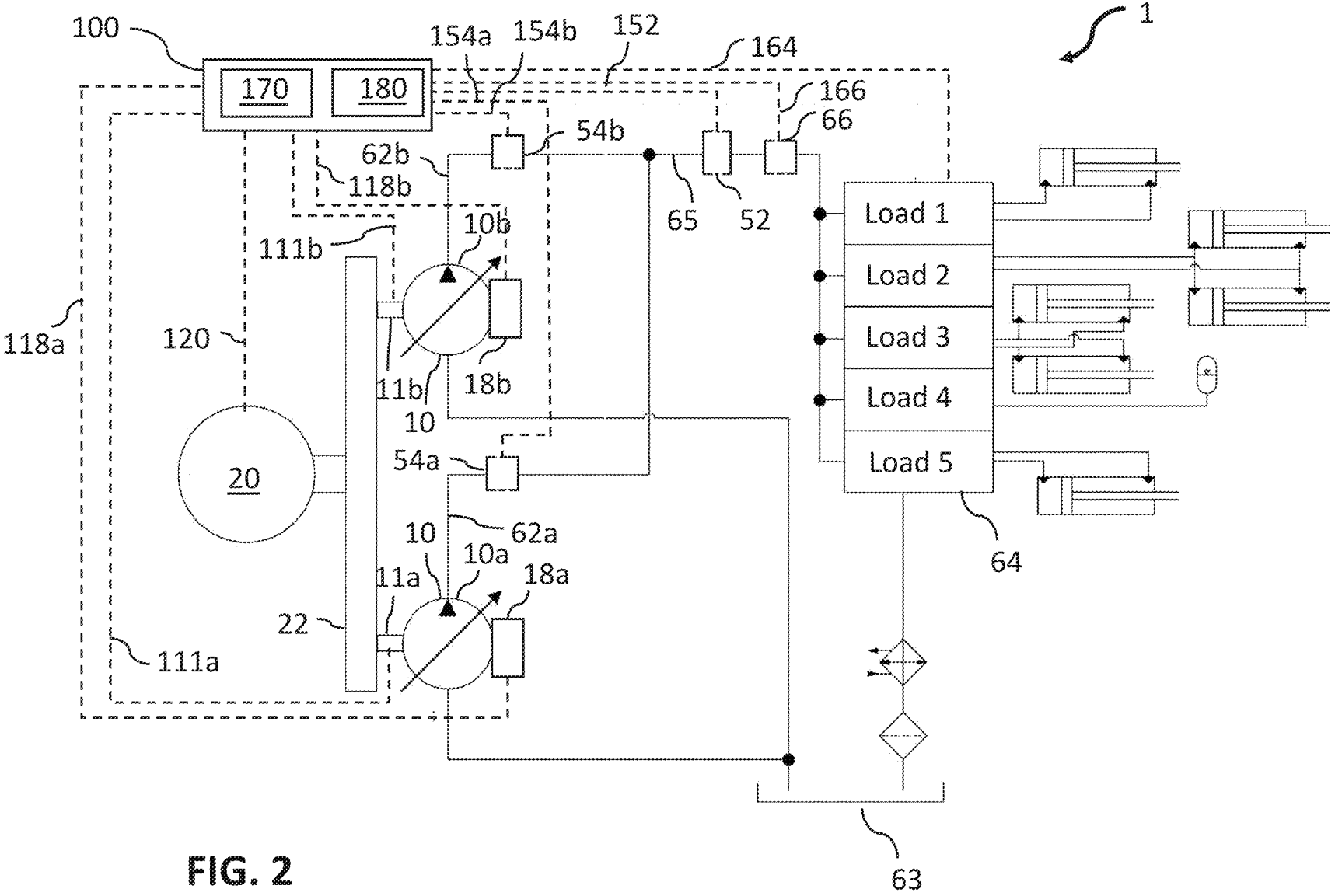
FIG. 2 is a schematic illustrating an embodiment of a hydraulic circuit arrangement including a plurality of EC pumps in accordance with an aspect of the present invention.

FIG. 2 is a schematic illustrating an embodiment of a hydraulic circuit arrangement 1 including a plurality of EC pumps 10*a*, 10*b*. In this embodiment, the hydraulic circuit arrangement 1 is an open loop circuit, wherein the working fluid is drawn from tank 63, is pumped through the EC pumps 10*a*, 10*b* and used to power loads 64 (i.e., loads 1-5) and then output back to tank 63.

A prime mover 20, in this instance a motor, drives both EC pumps 10*a*, 10*b* via gearbox 22 and respective pump crankshafts 11*a*, 11*b*.

Each EC pump 10*a*, 10*b* may have its own ECP controller 18*a*, 18*b* associated therewith. As described above, the ECP controllers 18 determine whether to enable or disable the individual piston cylinder assemblies 12 of the EC pumps 10 based on the current displacement fraction command for the respective pump. The ECP controllers 18*a*, 18*b* thus regulate the opening and/or closing of the individual low- and high-pressure valves of the EC pumps 10*a*, 10*b* to determine the displacement of fluid through each piston cylinder assembly 12 on a cycle-by-cycle basis to determine the net throughput of fluid through each of the groups 14 according to the respective flow demands.

The working fluid output 62*a* from EC pump 10*a* and the working fluid output 62*b* from EC pump 10*b* are combined into a common output hydraulic line 65 and then provided to the individual loads 64 as required or demanded. A pressure sensor 52 is provided in the common output hydraulic line 65 to measure the pressure of the working fluid therein.

In order to control pressure in a system where two or more EC pumps 10 are joined at their outlet, the pressure control logic may be moved into a system-level controller 100. This is because when two or more EC pumps 10 are pumping together, the combined output pressure ripple may phase in and out, causing low beat frequencies and simultaneous pulses from separate machines. This can be avoided with some coordination.

According to certain embodiments, a hydraulic circuit arrangement controller 100 may send and/or receive signals over electrical signal lines 120, 118*a*, 118*b*, 152, and 164, respectively, to/from prime mover 20, each of the respective ECP controllers 18*a*, 18*b* of EC pumps 10*a*, 10*b*, pressure sensor (or other pressure determining device) 52, and loads 64. Additionally, this system-level controller 100 may receive signals over electrical signal lines 111*a*, 111*b* from a position and/or speed sensor associated with shaft 11*a* and/or shaft 11*b* of EC pumps 10*a*, 10*b*.

Such sensors may provide a signal which can be used by system-level controller 100 to determine the instantaneous angular position and speed of rotation of these shafts. These position and speed determinations may enable controller 100 to determine the instantaneous phase of the cycles of each individual piston cylinder assembly 12 of the EC pumps 10*a*, 10*b*. Further, the system-level controller may use shaft speed information to determine the flow, where flow is proportional to the displacement fraction (Fd), the pump size and the shaft speed. Alternatively, the shaft speed of each EC pump 10*a*, 10*b* may be determined or measured by its associated ECP controller 18*a*, 18*b*, and that information may be then shared over a communication bus (for example, a Controller Area Network (CAN)).

Further, sensors 54*a*, 54*b* for measuring the flow output of the individual EC pumps 10*a*, 10*b* may be associated with the output hydraulic lines of these pumps. Signals over electrical signal lines 154*a*, 154*b* from these sensors 54*a*, 54*b* may be provided to controller 100.

Thus, it is understood that the system-level controller 100 provides the control logic. A CAN may be used to send displacement commands from controller 100 to ECP controllers 18*a*, 18*b*. A CAN is a serial bus system with multi-master and real-time capabilities. All CAN nodes are able to transmit data. More than one CAN node can request the bus simultaneously. Prioritized messages are transmitted, with each CAN node receiving the message and deciding based on a received identifier whether that node should process the message. While the system-level controller 100 controls the system logic and provides flow displacement commands to the individual ECP controllers, the individual ECP controllers 18*a*, 18*b* control the timing and operation of the inlet and optionally outlet valves (not shown) to achieve the commanded displacements for each of the EC pumps 10*a*, 10*b*.

Figure 4:
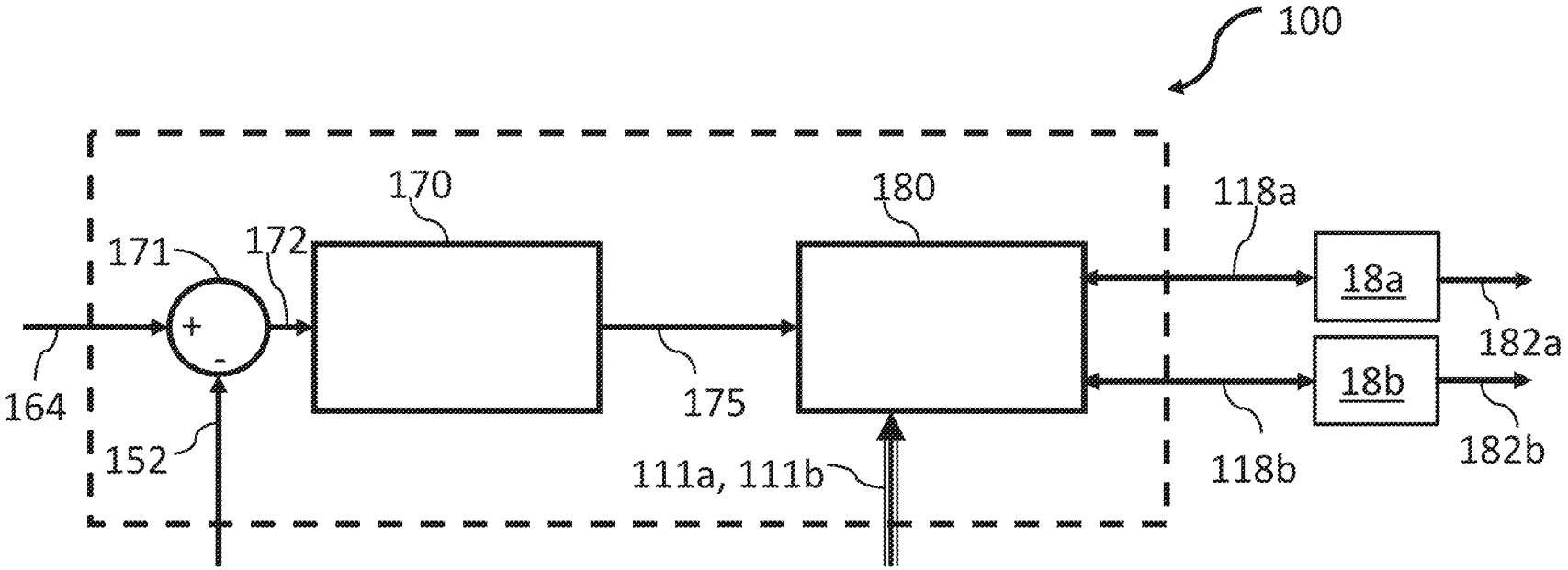
FIG. 4 is a schematic an embodiment of the control system for the hydraulic circuit arrangement of FIG. 2 and/or FIG. 3 in accordance with an aspect of the present invention.

Still referring to FIG. 2 and now also referring to FIG. 4, system-level controller 100 includes the logic for determining the required flow to meet the pressure demand and the logic for determining the allocation of flow to the EC pumps. For example, controller 100 may be provided with a pressure controller 170 that includes the logic for determining the required flow to meet the pressure demand and a flow divider 180 that includes the logic for determining the allocation of flow to the EC pumps. Pressure controller 170 may be provided with a pressure reference value 164. Pressure reference value 164 is determined as the pressure necessary to be provided to the requested load outputs of the loads 64, and is the system's target pressure value or demanded pressure. In one application, that pressure reference value 164 might be a constant value. In another application, that pressure reference value 164 might be calculated from another signal. In a load sensing application, the pressure of the load sense line would be measured to provide a further signal and the pressure ref value 164 would be calculated as the further signal added to an offset, where the offset is an additional variable. Pressure controller 170 may further be provided with an actual pressure value 152, or the pressure value 152 may be indirectly determined or deduced. For example, pressure value 152 may be measured by the pressure sensor 52 provided in the combined hydraulic output line 65 of the EC pumps 10*a*, 10*b*. A pressure difference value 172, which is the difference between the pressure reference value 164 and the pressure value 152, may be determined by pressure controller 170. Pressure controller 170 may further be provided with an additional offset, said offset to be applied on the pressure difference value 172. Pressure controller 170 may alternatively receive a pressure difference value 172 determined as the output of a comparator 171 that receives pressure reference value 164 and pressure value 152.

The pressure controller 170 includes the logic to calculate the flow required to keep or meet the target pressure value, the demanded or required pressure. For example, pressure controller 170 may determine a flow target value 175 based on the pressure difference value 172. Pressure controller 170 may be a proportional integral derivative (PID) controller. Because the pressure controller 170 calculates a flow target value 175 needed to reach the pressure reference value, the gains are in terms of flow.

Flow divider 180 receives signals from position and speed sensors associated with crankshafts 11*a*, 11*b* over electrical signal lines 11*a*, 111*b*. Flow divider 180 also communicates with ECP controllers 18*a*, 18*b* associated with EC pumps 10*a*, 10*b* over electrical signal lines 118*a*, 118*b*. In some embodiments (see e.g., FIG. 3), signals associated with the crankshaft position and/or speed sensors may be fed to ECP controllers 18*a*, 18*b*, and from there to system-level controller 100 and/or flow divider 180 via electrical signal lines 118*a*, 118*b*.

The flow divider 180 receives the flow target value 175 from pressure controller 170 and allocates the flow among EC pumps 10*a*, 10*b*. In other words, the total flow target value 175 is distributed by the flow divider 180 to thereby define the respective flow displacements 182*a*, 182*b* of each of the individual EC pumps 10*a*, 10*b*, respectively.

The flow divider 180 may also consider torque or power limits when allocating flow among the individual EC pumps 10*a*, 10*b*. It is expected that the flow divider 180 would generally not allocate more flow than the one or more prime movers 20 have power for at the current pressure measurement value. According to certain embodiments, quantized pumps may be converted to unquantized pumps (or vice versa) in order to meet a power limit. The individual power limits for any given prime mover 20 may be considered when allocating the flow among the individual EC pumps 10.

Figure 3:
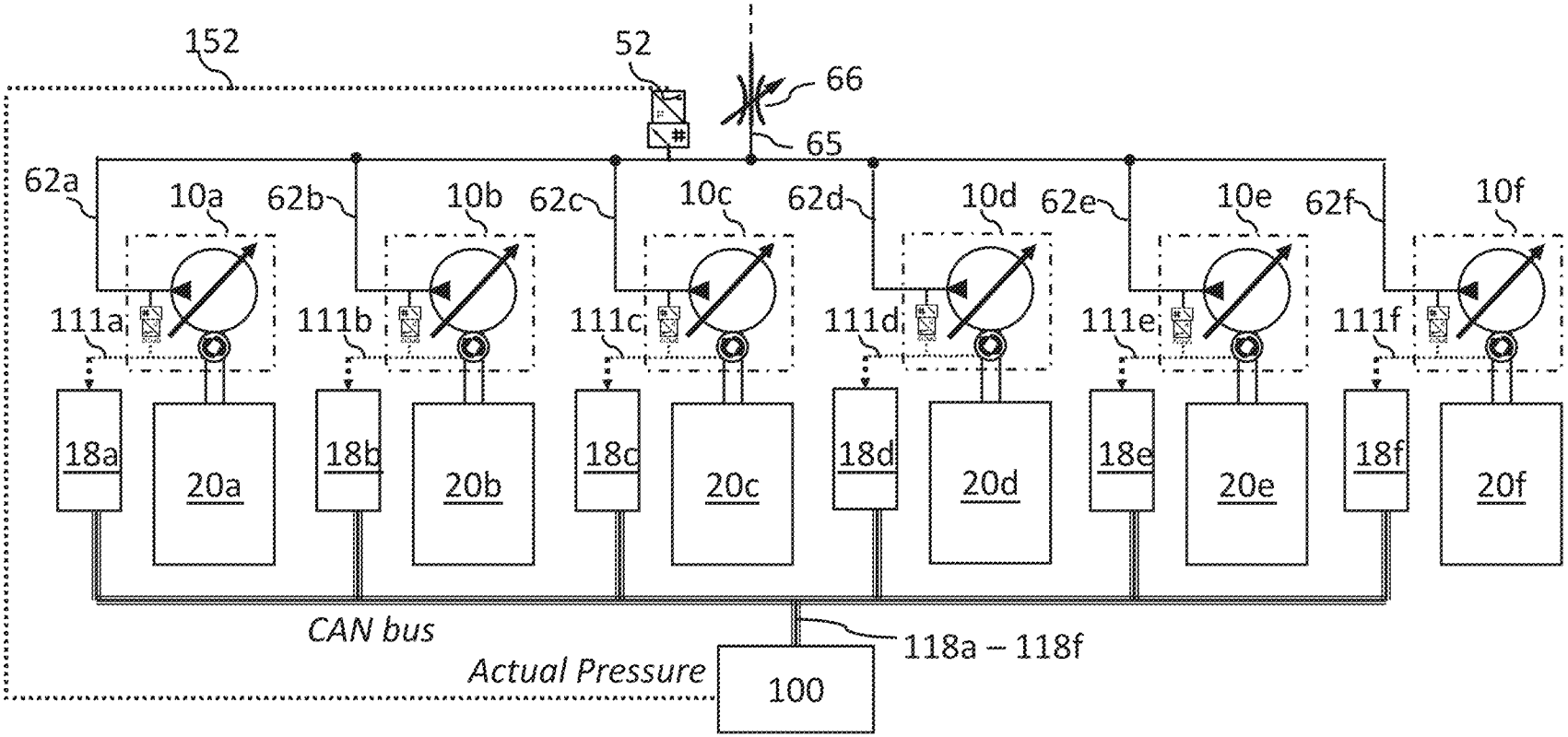
FIG. 3 is a schematic an embodiment of a portion of a hydraulic circuit arrangement including a plurality of EC pumps in accordance with an aspect of the present invention.

FIG. 3 is a schematic illustrating an embodiment of a portion of a hydraulic circuit arrangement 1 including a plurality of ganged EC pumps 10*a* through 10*f*. In this embodiment, each EC pump 10*a*-10*f* has its own prime mover 20*a* through 20*f*, respectively. Each of the prime movers 20 may be an electric motor and, as a non-limiting example, each of the electric motors may be turning at a similar speed. Optionally, a single prime mover 20 may be associate with one or more EC pumps 10 (not shown), or multiple prime movers 20 may be associated with a single EC pump 10 (not shown), or an array of prime movers 20 may be associated with an array of EC pumps 10 (not shown). Further, each EC pump 10*a*-10*f* has its own ECP controller 18*a* through 18*f* associated therewith. As described above, the ECP controllers 18 determine whether to enable or disable the individual piston cylinder assemblies 12 of the EC pumps 10 based on the current displacement fraction command for the respective pump.

FIG. 3 also illustrates that electrical signal lines 111*a* through 111*f* connect sensors associated with each EC pump and with each crankshaft of the EC pumps 10*a*-10*f* to the ECP controllers 18*a*-18*f*. Signals over electrical signal lines 111*a*-11 if may provide, as non-limiting examples, information indicative of the pressure associated with each EC pump and/or indicative of the speed and/or position of the crankshaft of each EC pump to the associated ECP controller. Electrical signal lines 118*a* through 118*f* connect the ECP controllers 18*a*-18*f* to the controller 100. For example, each of the ECP controllers 18*a*-18*f* may be connected to the system-level controller 100 via a CAN.

The working fluid outputs 62*a*-62*f* from each EC pump 10*a*-10*f* are combined into a common output hydraulic line 65. According to other embodiments (not shown), the EC pumps 10 may be combined or ganged to a plurality of hydraulic lines. One or more valves 66 may be provided in line 65 to adjustably provide flow to loads 64 (not shown). A pressure sensor 52 may be provided in the common output hydraulic line 65 to measure the actual pressure of the working fluid therein. An electrical signal line 152 may provide this actual pressure value as a pressure signal to system-level controller 100. Alternatively, other means may be used to measure, deduce, or otherwise determine the actual pressure of the working fluid in the common output hydraulic line 65 and provide a pressure signal to the controller 100 or determine the pressure within the controller 100.

Recurrent problems with EC pumps 10 may include noise, vibration, and harshness. EC pumps 10 can create very low pulsation frequencies, because of the way the inlet/outlet valves are enabled when using only full strokes. Low frequencies in the order of a few or tens of Hz are generally undesirable for most systems.

The control strategy disclosed herein uses "displacement quantization" to minimize pressure ripple and phasing effects when EC pumps 10 are ganged to a common outlet. A "quantized" EC pump is limited to a specific set of fractional displacements. The lowest or smallest fractional displacement in the set is typically selected so as to produce a frequency that is above the unwanted pulsation frequency. In contrast, the available fractional displacements of an "unquantized" EC pump are not limited to a specific set.

For example, certain ECP controllers 18 for certain EC pumps 10 may have 3601 different fractional displacement steps. In other words, the fractional displacements of an unquantized EC pump could be 0, 1/3600, 2/3600, . . . , 3600/3600. In this example, the steps of the fractional displacement are so fine, that in practice the fractional displacement steps act almost like a continuous ramp of displacement. An unquantized EC pump may be controlled to output flow at any of these 3601 fractional displacement values. To achieve certain values of these fractional displacements, several (or many) shaft revolutions need to be completed. Thus, fractional displacements may be viewed as "on average" the fractional displacement that produces a certain fraction (or percentage) of the full or 100% displacement.

It is to be understood that other EC pumps 10 may have a different number of unquantized fractional displacement steps. As another non-limiting example, the fractional displacements for an unquantized EC pump could be 0, 1/900, 2/900, . . . , 900/900 for a total of 901 fractional displacement steps. An unquantized EC pump may be controlled to output flow at any of these 901 fractional displacement values. The fractional displacements for a strictly-unquantized EC pump are typically hardcoded into the ECP controller and represent the finest fractional displacements that the pump can achieve.

A "quantized" EC pump will be limited to a subset of the total fractional displacements that an "unquantized" EC pump has available. Thus, for example, when unquantized, an EC pump may have N total fractional displacement values or steps available (for example, N=3601 and N=901 in the above two examples). When quantized, the allowable fractional displacements (Fd) of a quantized EC pump will be limited to a subset $N_S$ of the fractional displacement values. As one example, an EC pump having 901 fractional displacement values available may be quantized to a subset of fractional displacement values Fd={0, 1/10, 2/10, 3/10 . . . 10/10}, which corresponds to $N_S$=11. When "quantizing" the aforementioned unquantized EC pump having 901 possible fractional displacements to the above-proposed limiting set of exemplary fractional displacements, the quantized EC pump would be limited to fractional displacements of Fd={0, 90/900, 180/900, 270/900, . . . , 900/900}; which is the same as Fd={0, 9/90, 18/90, 27/90, . . . , 90/90}, but over a correspondingly smaller sequence; which is the same as Fd={0, 1/10, 2/10, 3/10 . . . 10/10} over a correspondingly even smaller sequence.

Quantizing the EC pumps places a limit on the lowest fractional displacement, among other things. For example, assume that the aforementioned unquantized EC pump having 901 possible fractional displacements is quantized as presented above, such that its fractional displacements are limited to Fd={0, 1/10, 2/10, 3/10 . . . 10/10}. If this EC pump has twelve piston cylinder assemblies per revolution of the crankshaft, and if it is rotating at, for example, 1800 rpm, the lowest pulsation frequency (fp) associated with operating this EC pump would be 36.0 Hz. As another non-limiting example, if this EC pump was quantized to Fd={0, 1/5, 2/5, 3/5 . . . 5/5}, then with all other parameters remaining the same, the lowest pulsation frequency (fp) associated with operating this EC pump would be 72.0 Hz.

As another non-limiting example of an equally-spaced set of fractional displacements, if this EC pump was quantized to Fd={0, 1/4, 2/4, 3/4, 4/4}={0, 1/4, 1/2, 3/4, 1/1}, then with all other parameters remaining the same, the lowest pulsation frequency (fp) associated with operating this EC pump would be 90.0 Hz. This set of quantized fractional displacements appears to create a particularly smooth pattern, with very little pulsation or no low frequency content, possibly due to the way the piston cylinders assemblies overlap (with these fractional displacements), thereby making the flow output very smooth. Further, with these fractional displacement values being evenly spread and with the gaps between each value of fractional displacement being relatively large, the commands for changing the fractional displacement of the quantized EC pump might be minimized or reduced compared to non-evenly spread sets of quantized fractional displacements. In practice, a balance between undesirable pressure fluctuations created by changes in the quantized Fd (the larger the change or step size, the greater the pressure fluctuation) and how often a change in the quantized Fd happens will need to be implemented on a system by system basis.

It may be desirable to not only have an equally-spaced set of fractional displacements in a fractional displacement series, but to also have these fractional displacement algorithms enable piston cylinder assemblies in an evenly-phased manner. "Evenly-phased" piston cylinder assemblies may be circumferentially or rotationally evenly-phased around the crankshaft 11 of the EC pumps. Circumferentially evenly-phased piston cylinder assemblies will be evenly angularly spaced around the crankshaft 11. Thus, for example, if there were twelve piston cylinder assemblies 12 in an EC pump 10 circumferentially equally-spaced around the shaft 11, then a fractional displacement algorithm enabling every second, third, fourth or sixth piston cylinder assembly would be "evenly-phased." Rotationally evenly-phased piston cylinder assemblies will be equally time spaced around the crankshaft 11.

In essence, quantizing an EC pump may prohibit the pump from producing flow pulsations at low frequencies which may be problematic. One method of quantizing an EC pump is illustrated above. A common denominator for the fractional displacements may be selected (e.g., 10 and 5 in the above two examples), and the fractional displacements may be equally-spaced. The denominator may be selected to prevent the pump from operating at or below the problematic frequency. Thus, for example, if a frequency of 22 Hz is problematic, a denominator of 10 (which limits the pump described above to a minimum pulsation frequency of 36 Hz) may be selected. If, as another example, a frequency of 60 Hz is problematic, a denominator of 5 (which limits the pump described above to a minimum pulsation frequency of 72 Hz) may be selected.

Another method of quantizing an EC pump involves selecting a "prime denominator" to prevent the pump from operating at or below the problematic frequency and then distributing the fractional displacements according to the "Farey sequence." According to this method, the fractional displacements are no longer equally-spaced, i.e., size of the fractional displacement steps varies. The Farey sequence is a sequence which is generated for order n, where n is considered the "prime denominator." The sequence has all rational numbers in range [0/0 to 1/1] sorted in increasing order such that the denominators are less than or equal to n and all numbers are in reduced forms, i.e., 4/4 cannot be in the sequence as it can be reduced to 1/1. Example Farey sequences include:

Farey sequence of order n=1: F1=0/1, 1/1

Farey sequence of order n=2: F2=0/1, 1/2, 1/1

Farey sequence of order n=3: F3=0/1, 1/3, 1/2, 2/3, 1/1

Farey sequence of order n=7: F7=0/1, 1/7, 1/6, 1/5, 1/4, 2/7, 1/3, 2/5, 3/7, 1/2, 4/7, 3/5, 2/3, 5/7, 3/4, 4/5, 5/6, 6/7, 1/1

When using Farey sequences to quantize an EC pump to avoid the lower frequencies, the order n (the "prime denominator") of the Farey sequence may be the denominator selected to prevent the pump from operating at or below those problematic frequencies. Thus, for example, if as discussed above, a frequency of 22 Hz is problematic and a prime denominator of 10 is selected (which limits the pump described above to a minimum pulsation frequency of 36 Hz), the fractional displacements as defined by the Farey sequence (F10) would be:

Fd={0/1, 1/10, 1/9, 1/8, 1/7, 1/6, 1/5, 2/9, 1/4, 2/7, 3/10, 1/3, 3/8, 2/5, 3/7, 4/9, 1/2, 5/9, 4/7, 3/5, 5/8, 2/3, 7/10, 5/7, 3/4, 7/9, 4/5, 5/6, 6/7, 7/8, 8/9, 9/10, 1/1}.

If, as also presented above, a frequency of 60 Hz is problematic and a prime denominator of 5 (which limits the pump described above to a minimum pulsation frequency of 72 Hz) is selected, then the fractional displacements as defined by the Farey sequence (F5) would be:

Fd={0/1, 1/5, 1/4, 1/3, 2/5, 1/2, 3/5, 2/3, 3/4, 4/5, 1/1}.

Thus, it is understood that the distributed set of fractional displacements for a quantized EC pump may be evenly or non-equally-spaced. Further, the distributed set of fractional displacements need not follow any specific sequence or mathematical series. Even further, according to one example, the EC pump could be quantized for displacements less than 50% (or some other predetermined percentage) of a full displacement value, and non-quantized for displacements above 50% (or some other predetermined percentage). In other words, a quantized EC pump may be quantized over certain percentage ranges of the full or 100% displacement, but unquantized over other ranges.

Another method of quantizing an EC pump involves selecting the lowest non-zero value for the sequence of fractional displacements that would prevent the pump from operating at or below a defined frequency, and then defining a distributed set of fractional displacements having increasing values. In essence, the distributed set of fractional displacements may be selected to avoid particular, defined, problematic frequencies and may otherwise appear to be randomly distributed.

As can be seen from the above description, the larger the selected common denominator or the prime denominator of the Farey sequence or the lowest non-zero value for the fractional displacements, the lower is the minimum pulsation frequency for a given EC pump with the same operating parameters. Thus, with a denominator of 10, the pump described above is limited to a minimum pulsation frequency of 36 Hz; while with a denominator of 5, the pump described above is limited to a minimum pulsation frequency of 72 Hz. Typical values for the quantization denominators or the prime denominator of the Farey sequence may be in the range of 12 to 24. In other words, typical values for the lowest non-zero value of the fractional displacements may range from 1/12 to 1/24. EC pumps having this level of quantization may have in the order of 12 to 24 fractional displacement steps if the steps are equally-spaced, or may have in the order of 30 to 50 steps if the steps are unequally-spaced. This level of quantization may be referred to as "common"-quantization. "Robust"-quantization refers to a more significant quantization, with the lowest non-zero value of fractional displacements ranging from 1/6 to 1/11. "Heavy"-quantization refers to a much more drastic quantization, with denominators less than or equal to 5 (i.e., the lowest non-zero fractional displacement value ranging from 1/5 to 1/2).

As described above, an unquantized EC pump is capable of outputting flow at any of its possible fractional displacement values (i.e., 3601 steps and 901 steps in the above two examples of unquantized pumps). When the unquantized EC pump is operated with its full set of fractional displacement steps it may be referred to as "strict"-unquantization (or strictly-unquantized). However, it is conceivable that an EC pump may be "effectively" unquantized. For example, the unquantized EC pump having 3601 possible different fractional displacement steps may be lightly or pseudo-quantized to have 901 possible different fractional displacements steps. This could be accomplished by applying a denominator of 900 to the fractional displacement steps, essentially limiting the 3601-step EC pump to only operating at every $4^{th}$ fractional displacement step. In such an instance, this quantized EC pump still has over 900 fractional displacement steps, which would be no different than the number of fractional displacement steps that a 901-step strictly-unquantized EC pump would have. "Effective"-unquantization (or effectively-unquantized) may refer to pseudo-quantization with prime denominators greater than 200 (i.e., the lowest non-zero fractional displacement value being greater than or equal to 1/200). "Nominal"-unquantization (or nominally-unquantized) may refer to a pseudo-quantization with prime denominators greater than 100 (i.e., the lowest non-zero fractional displacement value being greater than or equal to 1/100). "Practical"-unquantization (or practically-unquantized) may refer to a pseudo-quantization with prime denominators greater than 50 (i.e., the lowest non-zero fractional displacement value being greater than or equal to 1/50). Such pseudo-quantized EC pumps may be considered to be "effectively"- or "nominally"- or "practically"-unquantized EC pumps.

EC pumps having "continuous" and "discontinuous" ranges of displacements are disclosed in European Patent No. 2649348 to Caldwell et al. (filed Jan. 31, 2012), which is herein incorporated by reference in its entirety. EC pumps providing a continuously variable displacement have fractional displacements across the entire range (from 0 to 100%) that are so finely distributed that the user effectively experiences any changes in the flow as a smooth ramp. The discontinuously variable EC pumps have gaps or missing fractional displacements. Thus, a change in the flow of a discontinuously variable EC pump may be experienced as noticeable steps. According to certain embodiments, a continuously variable EC pump may have at least 50, equally-spaced, fractional displacement steps; while a discontinuously variable EC pump may have fewer than 50 fractional displacement steps. As other non-limiting examples, a continuously variable EC pump may have at least 100, 200, 900, or 1800, or with the latest electronics, at least 3600, equally-spaced, fractional displacement steps. As other non-limiting examples, a discontinuously variable EC pump may have fewer than 50, fewer than 10, or fewer than 5 fractional displacement steps.

The following control strategy uses displacement quantization to minimize pressure ripple and phasing effects when a plurality of EC pumps 10 are ganged to a common outlet. As noted above, EC pumps may be operated in an unquantized mode or in quantized mode.

According to certain aspects, at least one of the EC pumps is operated in an unquantized mode. For example, at least one of the EC pumps may be strictly-unquantized or effectively-unquantized or nominally-unquantized or practically-unquantized. Having one or more of the EC pumps remain unquantized allows the system to account for error and perform fine control.

Further, at least one of the EC pumps is operated in a quantized mode. For example, at least one of the EC pumps may be "commonly" quantized, "robustly" quantized, or even "heavily" quantized. Operating an EC pump in a quantized mode reduces its pulsation. Having one or more pumps operate in a quantized mode allows the system to account for error and perform fine control.

Thus, for example, referring to FIGS. 2 and 3, EC pump 10*a* may be operated in a unquantized mode, while EC pump 10*b* may be operated in an unquantized mode. According to certain aspects, the unquantized EC pump is updated at a higher rate via its ECP controller 18*a*, while the quantized EC pump may be updated at much slower rate via its ECP controller 18*b*. In order to achieve a fast response, the unquantized ECP controllers may receive their net displacement commands very frequently. As non-limiting examples, the unquantized ECP controllers may be updated at least every 1 ms, at least every 2 ms, or at least every 5 ms. In contrast, the quantized ECP controllers may receive their new net displacement commands less frequently or only when there is a change in the overall system's loading. Thus, for example, the quantized ECP controllers of the quantized EC pumps may not receive or process new displacement commands from the system-level controller at a specific frequency, but rather may receive new displacement commands depending on what the overall system is doing. As other non-limiting examples, the quantized ECP controllers may be updated with displacement commands no more often than every 10 ms, but the timing between displacement commands may be much greater, such as no more often than every 100 ms, or no more often than every second.

Referring to FIG. 3, it is to be understood that in a hydraulic circuit arrangement having at least three EC pumps 10*a*-10*f*, more than one EC pump 10 may be operated in the unquantized mode. For example, referring to FIGS. 3 and 4 two or more EC pumps 10*a*, 10*c*, etc. may be operated in an unquantized mode with each of these unquantized EC pumps being allocated a portion of the unquantized flow portion 182*a*.

Similarly, it is to be understood that in a hydraulic circuit arrangement having at least three EC pumps 10*a*-10*f*, more than one EC pump may be operated in the quantized mode. For example, two or more EC pumps 10*b*, 10*d*, etc. may be operated in the quantized mode with each of these quantized EC pumps being allocated a portion of the quantized flow portion 182*b*.

According to certain aspects, when the hydraulic circuit arrangement is provided with more than two EC pumps, the third EC pump may be selectively operated in an unquantized mode or in a quantized mode. Thus, for example, depending upon the pressure requirements of the loads 64 or, for example, whether certain loads 64 are on-line or, as another example, whether the hydraulic circuit arrangement is operating in a closed- or open-mode, a third (or fourth, fifth, etc.) EC pump may first operate in a quantized mode and then later may be relegated to an unquantized mode of operation.

Even further, from this description, it is apparent that the hydraulic circuit arrangement controller 100 may control the fractional displacement algorithms of the individual ECP controllers 18. In some instances, the system-level controller 100 may switch a pump from an unquantized mode to a quantized mode by sending a specified quantized fractional displacement algorithm to the ECP controller 18 of the (previously) unquantized pump. In other instances, controller 100 may switch a pump from a quantized mode to an unquantized mode by overriding or deleting the quantized pump's specified quantized fractional displacement algorithm. This may be implemented when, for example, an unquantized pump becomes disabled or unable to function properly. In such case, a pump operating in a quantized mode may be switched to operate in an unquantized mode so that at all times a pump operating in an unquantized mode is available. In some instances, such a conversion may be accomplished while maintaining the relative quantized and unquantized target flow values unchanged. In other instances, if a pump becomes inoperable, the relative quantized and unquantized target flow values may need to be proportionally reallocated even while maintaining the overall flow. In other instances, controller 100 may send a new quantized fractional displacement algorithm for an already quantized pump to a respective ECP controller. As such, for example, a robustly-quantized pump may be converted to a heavily-quantized pump. As another example, a quantized pump operating with a quantized fractional displacement algorithm according to a Farey sequence may be converted to a quantized pump operating with a quantized fractional displacement algorithm according to an equally-spaced sequence.

Figure 5:
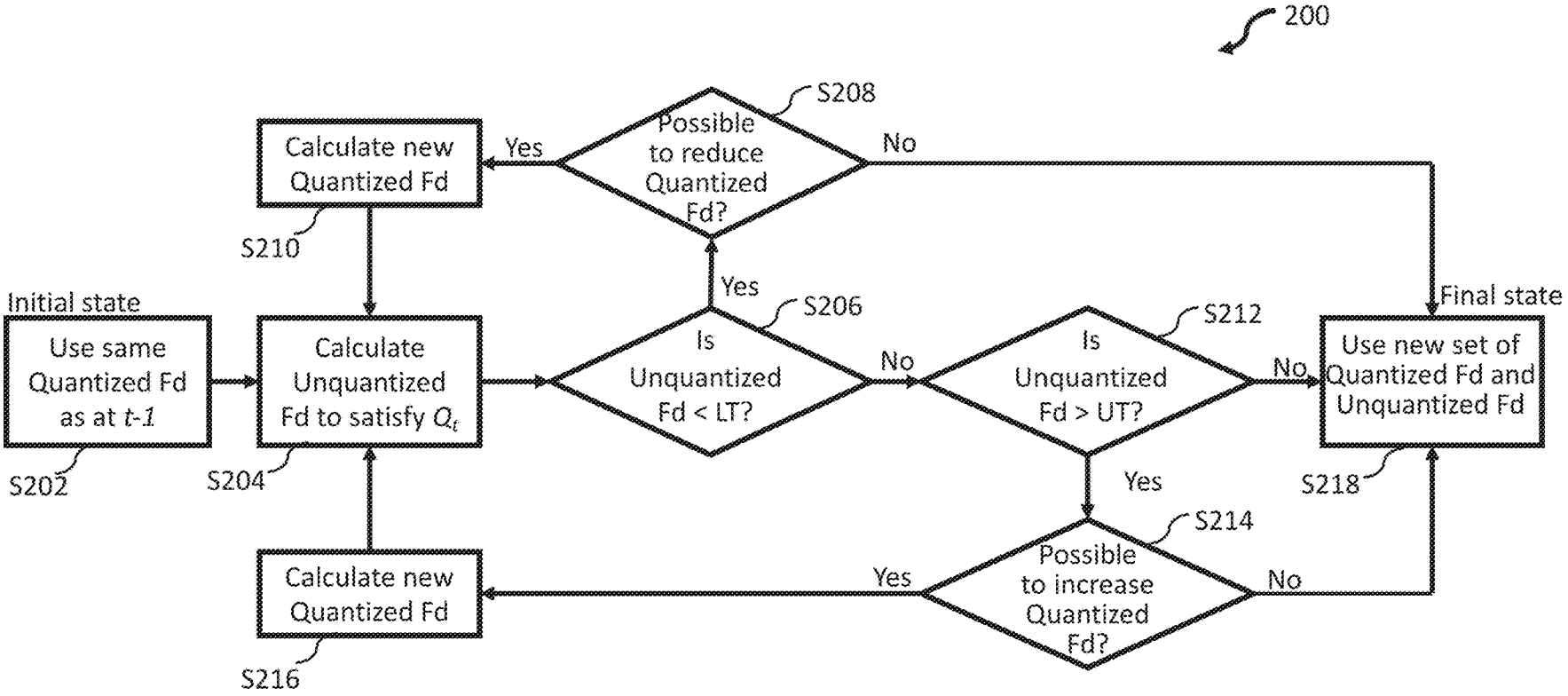
FIG. 5 is a flow chart showing an exemplary algorithm for the flow divider of FIG. 4 in accordance with an aspect of the present invention.

Referring to FIG. 4 and also to FIG. 5, flow divider 180 contains the logic to allocate the flow target value 175 between the unquantized and quantized EC pumps. The flow divider 180 receives the flow target value 175 from pressure controller 170 and defines the respective flow displacements 182 of each of the individual EC pumps 10.

Referring now to FIG. 5, according to one example algorithm, the flow divider logic iterates through the following steps:

Step S202 is the initial state at (t=0). For this step the total flow demand satisfied by the quantized EC pumps at (t−1) is determined and used as input for the next step.

Step S204: Calculate the flow demand of the unquantized EC pumps necessary to satisfy the new flow target value ($Q_t$) (i.e., the new total flow demand at t=0) by subtracting the total flow demand of the quantized EC pumps received from step S202.

Step S206: Determine if the flow demand of the unquantized EC pumps calculated at step S204 is less than a predetermined lower threshold (LT).

Step S208: If the answer to step S206 is "Yes," then at step S208, the algorithm determines if it is possible to reduce the flow demand of the quantized EC pumps.

Step S210: If the answer to step S208 is "Yes," than at step S210, the algorithm calculates a new, reduced, flow demand for the quantized EC pumps.

Step S204: Now, the flow demand of the unquantized EC pumps necessary to satisfy the new flow target value ($Q_t$) is recalculated by subtracting the total flow demand of the quantized EC pumps received from step S210.

Step S206: Again, determine if the flow demand of the unquantized EC pumps recalculated at step S204 is less than the lower threshold (LT).

Step S212: If the answer to step S206 is "No," then at step S212, the algorithm determines if the flow demand of the unquantized EC pumps calculated at step S204 is more than a predetermined upper threshold (UT).

Step S214: If the answer to step S212 is "Yes," then at step S214, the algorithm determines if it is possible to increase the flow demand of the quantized EC pumps.

Step S216: If the answer to step S214 is "Yes," than at step S216, the algorithm calculates a new, increased, flow demand for the quantized EC pumps.

Step S204: Now, the flow demand of the unquantized EC pumps necessary to satisfy the new flow target value ($Q_t$) is recalculated by subtracting the total flow demand of the quantized EC pumps received from step S216.

Step 218: If the answers to step S208, to step S212, or to step S214 is "No," then the algorithm proceeds to the final step, step S218 and a new set of quantized flow demands and unquantized flow demands are established.

According to this algorithm, the unquantized flow is preferably maintained between the lower threshold (LT) and the upper threshold (UT). If the unquantized flow falls below the lower threshold (LT), the algorithm attempts to increase the unquantized flow by decreasing the quantized flow, if possible. On the other hand, if the unquantized flow rises above the upper threshold (UT), the algorithm attempts to decrease the unquantized flow by increasing the quantized flow, if possible. The lower threshold (LT) may be the lowest fractional displacement value ($Fd_L$) (other than a fractional displacement of 0, i.e., 0%) available among the quantized EC pumps. Alternatively, the lower threshold (LT) may be the size of the smallest step between fractional displacements ($FD_{STEP}$) available among the quantized EC pumps. The upper threshold (UT) may be the greatest fractional displacement value ($Fd_G$) (other than a fractional displacement of 1, i.e., 100%) of the quantized EC pumps. Optionally, the lower threshold (LT) may be selected to be greater than the lowest fractional displacement value ($Fd_L$) and/or the upper threshold (UT) may be selected to be lower than the greatest fractional displacement value ($Fd_G$) in order to reduce the range of the preferably maintained unquantized flow.

The example algorithm of FIG. 5 involves calculating new quantized displacement demands when the system's flow demands change. According to one embodiment, the algorithm may allocate the fractional displacements evenly across the available quantized EC pumps. This embodiment is reflected in FIG. 6, wherein, for example, at time step 9, the allocated flow demands for the quantized EC pumps are spread evenly, i.e., with three quantized EC pumps, each pump is allocated at a fractional displacement of {0.25, 0.25, 0.25}, rather than being unevenly allocated at fractional displacements of {0.75, 0, 0}. Calculating new quantized and unquantized displacement commands can also be triggered by the failure of a valve. This is a decision not to allocate a particular piston cylinder assembly (or corresponding pump) because it does not provide the requested displacement any more, the commands can take this into account.

Controller 100 should not demand a pattern which would use the broken cylinder. ECP controller will decide not to command a broken cylinder, and hence will therefore 'limit' the displacement of that pump.

In one embodiment, once such a failure is indicated or recognized, the system controller should limit the set of quantized displacements (sent to the piston cylinder assembly, or pump, with the failure (e.g. broken valve)) to patterns that do not "rotate"/"precess" around the shaft (i.e. after a rotation of the shaft, with all the corresponding valve-firings in that revolution, the same valves will be fired in the next revolution, thus the valve firings will in effect not "rotate"/"precess" around the shaft). By this is meant that the piston cylinder assemblies used to create the pattern should not change over time. This means that acceptable patterns usable long term, never need to use a broken cylinder. As an example of a disallowed rotating pattern, Fd=5/12 would be using 5 piston cylinder assemblies on the 1st shaft revolution, then 5 other piston cylinder assemblies on the 2nd revolution and so on.

Referring now to FIG. 6, a table is presented illustrating the step-by-step results of a basic algorithm to allocate the flow between quantized and unquantized EC pumps. This table is based on an example hydraulic circuit arrangement having four EC pumps available to operate, each having a full or 100% flow displacement of 100 cc/rev and each spinning at 1000 rpm. One EC pump (ECP1) is unquantized and the remaining three EC pumps (ECP2, ECP3, ECP4) may be quantized to the following fractional displacement values: Fd={0, 0.25, 0.5, 0.75, 1}. The values shown in this exemplary table are consistent with a lower threshold (LT) equal to 0.25 Fd and an upper threshold (UT) equal to 0.75 Fd.

According to this example, the flow target value or the flow demand ($Q_t$) ramps up from 50 to 160 L/min, by steps of 10 L/min every iteration. Thus, at step 1, it can be seen that the flow target value ($Q_t$) is 50 L/min. The entirety of the flow demand is allocated to ECP1 at a fractional displacement of Fd=0.5. In this step 1, ECP2 through ECP4 are allocated a fractional displacement of Fd=0.0. Although ECP2 through ECP4 are available to be operated, in that their shafts are being turned by the prime mover, with an allocated fractional displacement of Fd=0.0 these pumps are operating in an "idling" mode with the piston-cylinder assemblies of these pumps providing zero displacement. At step 2, it can be seen that the flow target value ($Q_t$) has increased to 60 L/min. The entirety of the flow demand is still allocated to ECP1 at a fractional displacement of Fd=0.6. At step 3, the flow target value ($Q_t$) has increased to 70 Lmin. And, again the entirety of the flow demand is still allocated to ECP1 at a fractional displacement of Fd=0.7.

At step 4, the flow target value ($Q_t$) has increased to 80 L/min. At this level of flow demand, a portion of the flow target value ($Q_t$) is now allocated to the first quantized EC pump ECP2 and the remainder is allocated to the unquantized ECP1. Because the first fractional displacement step of quantized ECP2 is 0.25, this is the portion of the flow target value ($Q_t$) that is allocated to quantized ECP2. At a full or 100% displacement of 100 L/min per EC pump, the flow allocated to ECP2 is 25 L/min. The remainder of the flow demand of 80 L/min is 55 L/min and this flow displacement is allocated to the unquantized ECP1 at a fractional displacement of Fd=0.55.

At step 7, the flow target value ($Q_t$) has increased to 110 L/min. At this level of flow demand, a portion of the flow target value ($Q_t$) is now allocated to both the first quantized digital translation pump ECP2 and the second digital translation pump ECP3, again with the remainder being allocated to the unquantized ECP1. Because the first fractional displacement step of quantized ECP3 is 0.25, this is the portion of the flow target value ($Q_t$) that is allocated to quantized ECP3. The allocation to quantized ECP2 remains at the fractional displacement of 0.25. Thus, we see that the portions of the flow target value ($Q_t$) that are allocated to quantized ECP2 and quantized ECP3 are equal. At a full or 100% displacement of 100 L/min per EC pump, the flow allocated to ECP2 is 25 L/min and the flow allocated to ECP3 is 25 L/min. The remainder of the flow demand of 110 L/min is 60 L/min and this flow displacement is allocated to the unquantized ECP1 at a fractional displacement of Fd=0.6.

At step 9, the flow target value ($Q_t$) has increased to 130 L/min. At this level of flow demand, a portion of the flow target value ($Q_t$) is now allocated to both the first quantized digital translation pump ECP2, the second digital translation pump ECP3 and the third digital translation pump ECP4, again with the remainder being allocated to the unquantized ECP1. Because the first fractional displacement step of quantized ECP4 is 0.25, this is the portion of the flow target value ($Q_t$) that is allocated to quantized ECP4. The allocations to quantized ECP2 and quantized ECP3 remain at the fractional displacements of 0.25. Thus, we see that the portions of the flow target value ($Q_t$) that are allocated to quantized ECP2, quantized ECP3, and quantized ECP4 are equal. At a full or 100% displacement of 100 L/min per EC pump, the flow allocated to ECP2 is 25 L/min, the flow allocated to ECP3 is 25 L/min, and the flow allocated to ECP4 is 25 L/min. The remainder of the flow demand of 130 L/min is 55 L/min and this flow displacement is allocated to the unquantized ECP1 at a fractional displacement of Fd=0.55.

Finally, at step 12, the flow target value ($Q_t$) has increased to 160 L/min. At this level of flow demand, a portion of the flow target value ($Q_t$) is still allocated to both the first quantized digital translation pump ECP2, the second digital translation pump ECP3, and the third digital translation pump ECP4, again with the remainder being allocated to the unquantized ECP1. However, now the flow demanded of quantized ECP2 has been increased to the next fractional displacement step, i.e., Fd=0.5. The allocated flows demanded of quantized ECP3 and quantized ECP4 remain at the fractional displacements of 0.25. Thus, we see that the portions of the flow target value ($Q_t$) that are allocated to quantized ECP2, quantized ECP3, and quantized ECP4 are no longer equal. At a full or 100% displacement of 100 L/min per EC pump, the flow allocated to ECP2 is 50 L/min, the flow allocated to ECP3 is 25 L/min, and the flow allocated to ECP4 is 25 L/min. The remainder of the flow demand of 160 L/min is 60 L/min and this flow displacement is allocated to the unquantized ECP1 at a fractional displacement of Fd=0.6.

According to certain embodiments, as the total flow demand changes, the flow controller 100 has an algorithm that adds or subtracts fractional displacement chunks from the "next available" quantized EC pump to keep the produced flow close to, but below, the total flow demand. In other words, the algorithm fulfills as much of the flow demand as possible in quantized fractional displacement chunks. Typically, there will be a leftover flow demand since the quantized EC pumps generally will not be able to match the demand exactly.

The algorithm calculates the additional flow displacement(s) needed to fulfill the leftover flow demand. One or more unquantized EC pump(s) (or, optionally, other continuously-variable pump(s)) fulfill the rest of the flow demand. Thus, according to this algorithm, the quantized flow may be maximized and the unquantized flow may be minimized. The overall result is a set of EC pumps producing an accurate flow target while maintaining high levels of quantization to mitigate pulsation. As described above in para [0009], utilizing purely quantized EC pumps might result in the displacement command oscillating at low frequency between quantized fractional displacements. If the compliance in the fluid system is higher, it is thus possible to switch between fractional displacements at a higher frequency. In a control mode relying purely on quantized EC pumps, demanded displacements are met routinely through a control of the switching of the displacement command between quantized fractional displacements. The switching accounts for the error between the target flow value and the total quantized flow provided by the quantized pump(s). A minimum system compliance is required to allow for a controller time step in the order of a shaft revolution.

It should be noted that the terms, such as "comprising," "including" or "having," should be understood as not excluding other elements or steps and the words "a" or "an" should be understood as not excluding plurals of the elements or steps.

While the present disclosure has been illustrated and described with respect to one or more particular embodiment thereof, it should be appreciated by those of ordinary skill in the art that various modifications to this disclosure may be made without departing from the spirit and scope of the present disclosure.

What is claimed is:

1. A hydraulic circuit arrangement comprising:

a plurality of electronically-commutated pumps providing flow to a common hydraulic line, each of the electronically-commutated pumps provided with an associated electronically-commutated pump controller configured to determine whether to enable or disable individual piston cylinder assemblies of the electronically-commutated pumps based on a displacement command for the respective electronically-commutated pump, the electronically-commutated pump controllers configured to regulate the opening and/or closing of individual low and/or high pressure valves of the electronically-commutated pumps to thereby determine the displacement of fluid through each piston cylinder assembly on a cycle-by-cycle basis, the plurality of electronically-commutated pumps including one or more quantized electronically-commutated pumps and one or more unquantized electronically-commutated pumps, wherein the one or more quantized electronically-commutated pumps are configured to produce a quantized target flow value that is less than a total target flow value determined for the common hydraulic line, and wherein the one or more unquantized electronically-commutated pumps are configured to produce an unquantized target flow value that is the difference between the quantized target flow value and the total target flow value.

2. The hydraulic circuit arrangement according to claim 1, further comprising:

a system-level controller including:

a pressure controller configured to receive a pressure signal corresponding to a pressure within the common hydraulic line, to compare the pressure signal to a demanded pressure, and to determine the total target flow value required to produce the demanded pressure; and a flow divider configured to receive the total target flow value and allocate the total target flow value into the quantized target flow value for allocation among the one or more quantized electronically-commutated pumps and the unquantized target flow value for allocation among the one or more unquantized electronically-commutated pumps.

3. The hydraulic circuit arrangement of claim 1, wherein each of the individual electronically-commutated pumps has a shaft turning at a known speed, wherein the quantized target flow value is converted to a quantized target fractional displacement value based on the known speeds of the shafts of the individual quantized electronically-commutated pumps, and wherein the unquantized target flow value is converted to an unquantized target fractional displacement value based on the known speeds of the shafts of the individual unquantized electronically-commutated pumps.

4. The hydraulic circuit arrangement of claim 1, wherein a pressure associated with the common hydraulic line and a proportional integral derivative algorithm are used to determine the total target flow value.

5. The hydraulic circuit arrangement of claim 1, wherein the unquantized target flow value is compared to a predetermined upper threshold flow value to determine if a portion of the unquantized target flow value can be reallocated to the quantized target flow value.

6. The hydraulic circuit arrangement of claim 3, wherein the unquantized target fractional displacement value is compare to a predetermined upper threshold displacement value to determine if a portion of the unquantized target fractional displacement value can be reallocated to the quantized target fractional displacement value, and/or wherein the unquantized target flow value is compared to a predetermined lower threshold flow value to determine if a portion of the quantized target flow value can be reallocated to the unquantized target flow value, and/or wherein the unquantized target fractional displacement value is compared to a predetermined lower threshold displacement value to determine if a portion of the quantized target fractional displacement value can be reallocated to the unquantized target fractional displacement value.

7. The hydraulic circuit arrangement of claim 1, wherein the hydraulic circuit arrangement includes a plurality of quantized electronically-commutated pumps, and wherein the quantized target flow value is allocated to the plurality of quantized electronically-commutated pumps as evenly as possible.

8. The hydraulic circuit arrangement of claim 1, wherein at least one of the one or more quantized electronically-commutated pumps is a commonly-quantized electronically-commutated pump, or wherein at least one of the one or more quantized electronically-commutated pumps is a robustly-quantized electronically-commutated pump, or wherein at least one of the one or more quantized electronically-commutated pumps is a heavily-quantized electronically-commutated pump, or wherein at least one of the one or more quantized electronically-commutated pumps has a fractional displacement series that follows a Farey sequence.

9. The hydraulic circuit arrangement of claim 1, wherein at least one of the one or more quantized electronically-commutated pumps has a fractional displacement series that is equally-spaced in the series.

10. The hydraulic circuit arrangement of claim 9, wherein at least one of the electronically-commutated pumps includes a plurality of piston cylinder assemblies circumferentially arranged around a crankshaft, and wherein fractional displacements of the fractional displacement series that are equally-spaced enable the piston cylinder assemblies in an evenly-phased manner.

11. The hydraulic circuit arrangement of claim 1, wherein the hydraulic circuit arrangement includes one or more prime movers configured to drive the plurality of electronically-commutated pumps, and wherein allocating the target flow value to the quantized and unquantized electronically-commutated pumps takes into account torque and/or power limits of the prime movers.

12. The hydraulic circuit arrangement of claim 1, wherein at least one of the one or more unquantized electronically-commutated pumps is a strictly-unquantized electronically-commutated pump, or wherein at least one of the one or more unquantized electronically-commutated pumps is an effectively-unquantized electronically-commutated pump, or wherein at least one of the one or more unquantized electronically-commutated pumps is a nominally-unquantized electronically-commutated pump, or, wherein at least one of the one or more unquantized electronically-commutated pumps is a practically-unquantized electronically-commutated pump.

13. The hydraulic circuit arrangement of claim 2, wherein the system-level controller is configured to selectively switch one of the electronically-commutated pumps from a quantized mode to an unquantized mode, and/or selectively switch one of the electronically-commutated pumps from an unquantized mode to a quantized mode, and/or to specify a new quantized fractional displacement algorithm for one of the quantized electronically-commutated pumps.

14. The hydraulic circuit arrangement of claim 2, wherein the system-level controller is configured to preferentially maximize the quantized flow and to minimize the unquantized flow without switching any of the electronically-commutated pumps from a quantized mode to an unquantized mode, and without switching any of the electronically-commutated pumps from an unquantized mode to a quantized mode, and without specifying a new quantized fractional displacement algorithm for any of the quantized electronically-commutated pumps, and/or wherein the system-level controller is configured to update a displacement command allocating the unquantized target flow value to the one or more unquantized electronically-commutated pumps more often than the system-level controller updates a displacement command allocating the quantized target flow value to the one or more quantized electronically-commutated pumps.

15. A hydraulic circuit arrangement comprising:

a plurality of electronically-commutated pumps providing flow to a common hydraulic line, each of the electronically-commutated pumps provided with an associated electronically-commutated pump controller configured to determine whether to enable or disable individual piston cylinder assemblies of the electronically-commutated pumps based on a displacement command for the respective electronically-commutated pump, the electronically-commutated pump controllers configured to regulate the opening and/or closing of individual low and/or high pressure valves of the electronically-commutated pumps to thereby determine the displacement of fluid through each piston cylinder assembly on a cycle-by-cycle basis, the plurality of electronically-commutated pumps including one or more quantized electronically-commutated pumps; and one or more continuously-variable pumps providing flow to the common hydraulic line;

wherein the one or more quantized electronically-commutated pumps are configured to produce a quantized target flow value that is less than a total target flow value determined for the common hydraulic line, and wherein the one or more continuously-variable pumps are configured to produce an unquantized target flow value that is the difference between the quantized target flow value and the total target flow value.

* * * * *